US009145022B2

(12) United States Patent
Imai et al.

(10) Patent No.: US 9,145,022 B2
(45) Date of Patent: Sep. 29, 2015

(54) IMAGE RECORDING METHOD

(71) Applicant: CANON KABUSHIKI KAISHA, Tokyo (JP)

(72) Inventors: Takashi Imai, Kawasaki (JP); Mamiko Kaji, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 184 days.

(21) Appl. No.: 13/920,337

(22) Filed: Jun. 18, 2013

(65) Prior Publication Data

US 2013/0342622 A1 Dec. 26, 2013

(30) Foreign Application Priority Data

Jun. 20, 2012 (JP) ..... 2012-138390

(51) Int. Cl.

| | |
|---|---|
| ***B41J 2/01*** | (2006.01) |
| ***B41M 5/025*** | (2006.01) |
| ***B41J 2/21*** | (2006.01) |
| ***B41M 5/035*** | (2006.01) |

(52) U.S. Cl.

CPC ..... *B41M 5/025* (2013.01); *B41J 2/2107* (2013.01); *B41M 5/0256* (2013.01); *B41M 5/0356* (2013.01)

(58) Field of Classification Search

CPC ..... B41J 2/01; B41J 2/211; B41J 2/1433; B41J 2/17; B41J 2/17593; B41J 2/2107; B41J 2/1755; B41J 2/2114; B41J 11/0015; B41J 2/2056; B41J 2/21; C09D 11/36; C09D 11/40; C09D 11/30; C09D 11/38; C09D 11/322; C09D 11/328; C09D 11/101; C09D 11/005; C09D 11/54; C09D 11/52; B41M 5/0011; B41M 5/0017; B41M 7/00

USPC ..... 347/100, 95, 96, 103, 102, 101, 21, 20, 347/99, 88; 106/31.6, 31.13, 31.27; 523/160, 161

See application file for complete search history.

(56) References Cited

U.S. PATENT DOCUMENTS

| | | | | |
|---|---|---|---|---|
| 2010/0225707 | A1* | 9/2010 | Kudo et al. | 347/100 |
| 2010/0295891 | A1* | 11/2010 | Goto et al. | 347/21 |
| 2011/0269885 | A1* | 11/2011 | Imai | 524/376 |
| 2013/0328973 | A1* | 12/2013 | Kakikawa et al. | 347/86 |

FOREIGN PATENT DOCUMENTS

| | | |
|---|---|---|
| JP | 7-32721 A | 2/1995 |

* cited by examiner

*Primary Examiner* — Manish S Shah

(74) *Attorney, Agent, or Firm* — Canon USA Inc. IP Division

(57) ABSTRACT

Provided is an image recording method having high transfer efficiency. An image recording method includes an intermediate image-recording step of recording an intermediate image by applying ink to an intermediate transfer body and also includes a transfer step of transferring the intermediate image to a recording medium by heating the intermediate image to a transfer temperature. The ink contains polymer particles having a softening point not higher than the transfer temperature and at least one of a compound represented by Formula (1) and a compound represented by Formula (2).

7 Claims, 1 Drawing Sheet

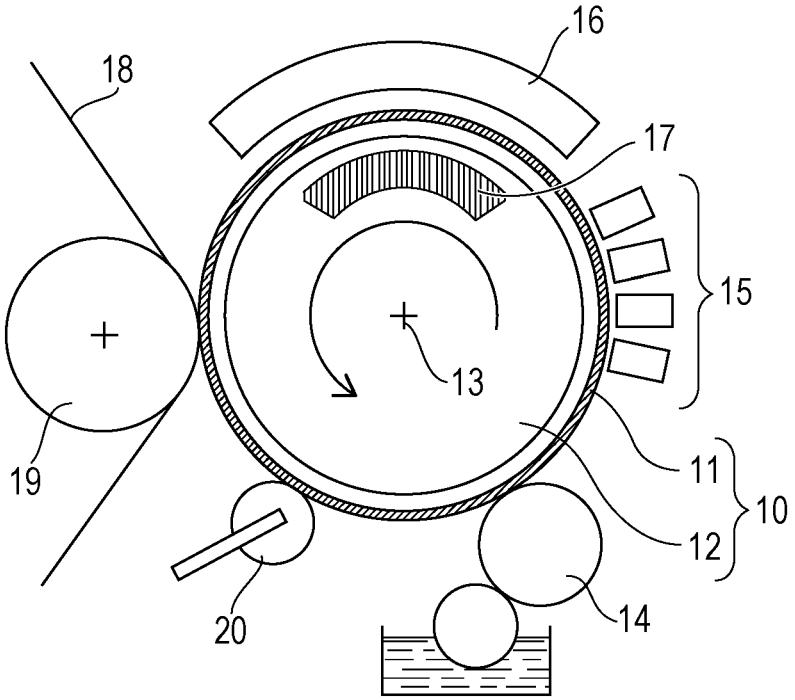
16
18
17
15
13
19
11
10
12
20
14

IMAGE RECORDING METHOD

BACKGROUND OF THE INVENTION

1. Field of the Invention

The present invention relates to an image recording method.

2. Description of the Related Art

There is a method (hereinafter also referred to as "intermediate transfer-type image recording method") in which an intermediate image is recorded by applying ink to an intermediate transfer body and an image is recorded by transferring the intermediate image to a recording medium. As the demand for high-speed recording has been growing in recent years, an intermediate transfer-type image recording method of obtaining a high-quality image at a high transfer rate is under investigation. In the intermediate transfer-type image recording method, the efficiency of transferring an intermediate image formed on an intermediate transfer body to a recording medium significantly affects the quality of an obtained image. In order to improve the efficiency of transfer, a method using an ink containing polymer particles has been investigated as described in Japanese Patent Laid-Open No. 7-32721 (hereinafter referred to as "patent document"). The patent document discloses that the transfer efficiency is improved in such a manner that an ink containing polymer particles with a minimum film-forming temperature of 50° C. or higher is heated to a temperature not lower than the minimum film-forming temperature thereof before transfer.

However, according to investigations made by the inventors, no high-quality image has been obtained in the case of performing recording at high transfer rate using the polymer particle-containing ink described in the patent document.

SUMMARY OF THE INVENTION

The present invention provides an image recording method which has high transfer efficiency and which is capable of obtaining a high-quality image even if the image is recorded at a high transfer rate.

An image recording method according to the present invention includes an intermediate image-recording step of recording an intermediate image by applying ink to an intermediate transfer body and a transfer step of transferring the intermediate image to a recording medium by heating the intermediate image to a transfer temperature. The ink contains polymer particles having a softening point not higher than the transfer temperature and at least one of a compound represented by the following formula (1) and a compound represented by the following formula (2):

(1)

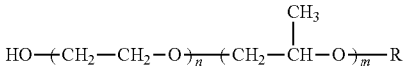

(2)

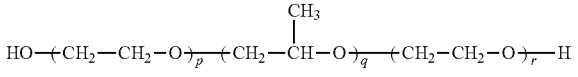

where R is an alkyl group containing one to 22 carbon atoms, n is 3.0 to 27.0, m is 2.0 to 15.0, the sum of p and r is 3.0 to 27.0, and q is 16.0 to 31.0.

According to the present invention, an image recording method having high transfer efficiency can be provided.

Further features of the present invention will become apparent from the following description of exemplary embodiments with reference to the attached drawing.

BRIEF DESCRIPTION OF THE DRAWINGS

The FIGURE is a schematic view of an example of an image recording apparatus used in the image recording method according to the present invention.

DESCRIPTION OF THE EMBODIMENTS

The present invention will now be described in detail with reference to preferred embodiments. The inventors have investigated requirements for achieving a high transfer rate in an intermediate transfer-type image recording method using ink containing polymer particles. Details are described below.

The polymer particles significantly affect the transfer efficiency of an intermediate image formed on an intermediate transfer body using the polymer particle-containing ink. This is because the polymer particles have a softening point and therefore significantly vary in state in a step of heating the intermediate image to a transfer temperature and then transferring the intermediate image to a recording medium. Thus, in order to enhance the transfer efficiency of the intermediate image, it is important to investigate the state of the polymer particles heated to a transfer temperature.

The inventors have investigated the state of the polymer particles heated to a transfer temperature and have found that in order to enhance the transfer efficiency, the polymer particles need to be contacted with the recording medium during transfer in such a state that the polymer particles are soft. That is, the transfer temperature needs to be not lower than the softening point of the polymer particles. This is because the softened polymer particles have increased viscosity and therefore have increased adhesion to the transferred recording medium. However, under these conditions, an intermediate image partly remains on the intermediate transfer body in some cases. This is because the softened polymer particles have increased adhesion to the intermediate transfer body. Therefore, in order to achieve high transfer efficiency, it is important that the softened polymer particles have reduced adhesion to the intermediate transfer body and increased adhesion to the recording medium.

Therefore, the inventors have investigated various compounds useful for inks to reach a configuration according to the present invention, that is, ink containing at least one of a compound represented by Formula (1) below and a compound represented by Formula (2) below. A mechanism for achieving effects of the present invention by this configuration is described below.

(1)

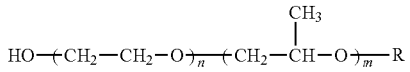

In Formula (1), R is an alkyl group containing one to 22 carbon atoms, n is 3.0 to 27.0, and m is 2.0 to 15.0.

(2)

$$HO-(CH_2-CH_2-O)_p-(CH_2-\overset{\overset{CH_3}{|}}{CH}-O)_q-(CH_2-CH_2-O)_r-H$$

In Formula (2), the sum of p and r is 3.0 to 27.0 and q is 16.0 to 31.0.

The compounds represented by Formulae (1) and (2) have an ethylene oxide group ($CH_2CH_2O$) which is highly hydrophilic and a propylene oxide group ($CH_2CH(CH_3)O$) which is less hydrophilic and therefore exhibit surface activity, which is lower than that of common surfactants. Therefore, when ink contains the compounds represented by Formulae (1) and (2) and the polymer particles, the compounds represented by Formulae (1) and (2) are not oriented at the air-liquid interface of the ink and are likely to be present in such a state that the compounds represented by Formulae (1) and (2) are adsorbed on the polymer particles. The compounds, represented by Formulae (1) and (2), adsorbed on the polymer particles reduce the adhesion between the intermediate transfer body and the polymer particles. In contrast, the compounds, represented by Formulae (1) and (2), adsorbed on the polymer particles increase the adhesion between the polymer particles and the recording medium. This is probably because the compounds, represented by Formulae (1) and (2), adsorbed on the polymer particles permeate the recording medium and therefore the polymer particles are likely to migrate to the recording medium. As described above, in the present invention, since the transfer temperature is not lower than the softening point of the polymer particles and ink contains the compounds represented by Formulae (1) and (2) and the polymer particles, an increase in viscosity due to the softening of the polymer particles and the surface activity of the compounds represented by Formulae (1) and (2) reduce the adhesion between the polymer particles and the intermediate transfer body and increase the adhesion between the polymer particles and the recording medium; hence, high transfer efficiency is achieved. According to investigations made by the inventor, when n or m in Formula (1) or p+r or q in Formula (2) does not satisfy the above specific range, any effect due to the compounds represented by Formulae (1) and (2) is not obtained. Components synergistically produce an effect like the above mechanism, whereby effects of the present invention can be achieved.

Image Recording Method

An image recording method according to the present invention includes an intermediate image-recording step (A) of recording an intermediate image by applying ink to an intermediate transfer body and a transfer step (B) of transferring the intermediate image to a recording medium by heating the intermediate image to a transfer temperature. A unit for applying the ink to the intermediate transfer body in the intermediate image-recording step (A) is preferably an ink jet system. In particular, a system ejecting the ink from an ejecting port of a recording head by applying heat energy to the ink is preferred.

In the transfer step (B), the recording medium is contacted with the intermediate image recorded on the intermediate transfer body and the intermediate image is heated to the transfer temperature and is then transferred from the intermediate transfer body to the recording medium. This allows an image to be recorded on the recording medium. In the present invention, examples of the recording medium include not only paper used for common printing but also fabric, plastic, and film. When being used in the image recording method according to the present invention, the recording medium may be cut into a desired size in advance. The recording medium may be a rolled sheet, which is cut into a desired size after image recording. In the present invention, the recording medium preferably has a surface roughness R of 1.0 μm or less. The surface roughness R of the recording medium is determined in such a manner that the recording medium is measured with a laser microscope, VK-9710, available from Keyence Corporation at an objective magnification of 20×.

Examples of a method of heating the intermediate image to the transfer temperature include a method of heating a roller to a desired transfer temperature and a method using a heater. The transfer temperature is preferably set to a temperature not lower than the softening point of the polymer particles and is more preferably 25° C. to 200° C.

When the intermediate image is transferred to the recording medium, both of the intermediate transfer body and the recording medium are preferably pressed using, for example, pressure rollers or the like. The transfer efficiency can be enhanced by pressing. In this operation, pressing may be performed stepwise.

High transfer efficiency needs to be achieved at high transfer rate as the demand for high-speed recording has been growing in recent years as described above. Thus, in the present invention, the transfer rate is preferably 1.0 m/s or more and more preferably 2.0 m/s or more.

The image recording method may further include a step of applying a liquid composition to the intermediate transfer body prior or subsequently to the intermediate image-recording step (A). The liquid composition may contain such a reactant that precipitates or aggregates an ink component such as a colorant or polymer. Examples of a technique for applying the liquid composition to the intermediate transfer body include applying methods such as a roller coating method, a bar coating method, and a spray coating method and ink jet methods. In particular, an applying method is preferably used to apply the liquid composition to the intermediate transfer body. Examples of the reactant include polyvalent metal ions and organic acids.

The image recording method may further include a step of pressing the recording medium having the intermediate image transferred thereto using a roller or the like subsequently to the transfer step (B). The smoothness of an image can be enhanced by pressing. Before the recording medium having the intermediate image transferred thereto is pressed with the roller, the roller is preferably heated. The fastness of the intermediate image can be enhanced by pressing the recording medium with the heated roller.

The image recording method may further include a step of cleaning a surface of the intermediate transfer body subsequently to the transfer step (B). A method of cleaning the intermediate transfer body may be any method conventionally used. Examples of the method of cleaning the intermediate transfer body include a method of showering a cleaning liquid on the intermediate transfer body, a method of wiping the intermediate transfer body by causing a wet molleton roller to abut against the intermediate transfer body, a method of contacting the intermediate transfer body with a cleaning liquid surface, a method of wiping residue from the intermediate transfer body with a wiper blade, a method of applying various types of energy to the intermediate transfer body, and a combination of some of these methods.

The FIGURE is a schematic view of an example of an image recording apparatus used in the image recording method according to the present invention. With reference to the FIGURE, the image recording apparatus includes an intermediate transfer body 10. The intermediate transfer body 10 includes a support member 12 which is rotatable and which has a drum shape and a surface layer member 11 placed on the circumference surface of the support member 12. The surface layer member 11 is a layered member composed of, for example, silicon rubber and a PET sheet. The surface layer member 11 is fixed on the circumference surface of the support member 12 with a double-faced adhesive tape or the like. The intermediate transfer body 10 (support member 12) rotates about a rotation axis 13 in the direction of an arrow (anticlockwise in the FIGURE). Members arranged around the intermediate transfer body 10 operate synchronously with the rotation of the intermediate transfer body 10. When the image recording method includes the step of applying the liquid composition to the intermediate transfer body 10, the liquid composition may be applied to the intermediate transfer body 10 with an application roller 14 or the like. Ink is ejected from an ink jet type of recording head 15 such that an intermediate image which is a mirror-inverted desired image is recorded on the intermediate transfer body 10. A recording medium 18 is contacted with the intermediate transfer body 10 using a pressure roller 19 heated to the transfer temperature, whereby the intermediate image is transferred to the recording medium 18. The image recording apparatus may further includes a cleaning unit 20 used in the step of cleaning a surface of the intermediate transfer body 10.

Ink

The ink used in the image recording method according to the present invention contains the polymer particles and the compounds represented by Formulae (1) and (2). The term "(meth)acrylic acid" as used herein includes acrylic acid and methacrylic acid. The term "(meth)acrylate" as used herein includes acrylates and methacrylates.

Polymer Particles

The term "polymer particles" as used herein refers to polymer that is dispersed in a solvent so as to have a pore size. In the present invention, the polymer particles preferably have a 50% accumulated volume-average particle diameter ($D_{50}$) of 10 nm to 1,000 nm and more preferably 50 nm to 500 nm. In the present invention, the 50% accumulated volume-average particle diameter of the polymer particles is measured as described below. A dispersion containing the polymer particles is 50 times diluted with pure water on a volume basis. The diluted dispersion is measured using an instrument, UPA-EX150, available from Nikkiso Co., Ltd. under the following conditions: a SetZero time of 30 s, a total of three measurement times, a measurement time of 180 s, and a refractive index of 1.5.

The polymer particles preferably have a weight-average molecular weight of 1,000 to 2,000,000 in terms of polystyrene as determined by gel permeation chromatography (GPC).

Furthermore, the polymer particles preferably have a softening point of 20° C. to 100° C. In the present invention, the softening point of the polymer particles corresponds to a lower one of the glass transition point (Tg) and the melting point (Tm). The glass transition point or melting point of the polymer particles can be measured with a differential scanning calorimeter (DSC).

In the present invention, the content of the polymer particles in the ink is preferably 1.0% to 50.0% by mass and more preferably 2.0% to 40.0% by mass on the basis of the mass of the ink.

The content of the polymer particles in the ink is preferably 0.2 to 20 times the content of a colorant below in the ink on a mass basis.

In the present invention, the polymer particles may be any particles that meet the definition of the polymer particles. Such particles can be used in the ink. A monomer used to prepare the polymer particles may be any one that can be polymerized by emulsion polymerization, suspension polymerization, dispersion polymerization, or the like. Examples of the polymer particles include acrylic polymer particles, polyvinyl acetate particles, polyester particles, polyethylene particles, polyurethane particles, synthetic rubber particles, polyvinyl chloride particles, polyvinylidene chloride particles, and polyolefin particles. In particular, the acrylic polymer particles and the polyurethane particles are preferred.

Examples of a monomer useful in preparing the acrylic polymer particles include α,β-unsaturated carboxylic acids such as (meth)acrylic acid, maleic acid, crotonic acid, angelic acid, itaconic acid, and fumaric acid; salts of the α,β-unsaturated carboxylic acids; α,β-unsaturated carboxylic esters such as ethyl (meth)acrylate, methyl (meth)acrylate, butyl (meth)acrylate, methoxyethyl(meth)acrylate, ethoxyethyl (meth)acrylate, diethylene glycol(meth)acrylate, triethylene glycol(meth)acrylate, tetraethylene glycol(meth)acrylate, polyethylene glycol(meth)acrylate, methoxydiethylene glycol(meth)acrylate, methoxytriethylene glycol(meth)acrylate, methoxytetraethylene glycol(meth)acrylate, methoxypolyethylene glycol(meth)acrylate, cyclohexyl(meth)acrylate, isobornyl(meth)acrylate, N,N-dimethylaminopropyl(meth) acrylate, monobutyl maleate, and dimethyl itaconate; α,β-unsaturated carboxylic alkylamides such as (meth)acrylamide, dimethyl(meth)acrylamide, N,N-dimethylethyl(meth) acrylamide, N,N-dimethylpropyl(meth)acrylamide, isopropyl(meth)acrylamide, diethyl(meth)acrylamide, (meth)acryloyl morpholine, maleic monoamide, and crotonic methylamide; α,β-ethylenically unsaturated compounds, such as styrene, α-methylstyrene, vinyl phenylacetate, benzyl (meth)acrylate, and 2-phenoxyethyl(meth)acrylate, containing an aryl group; and polyfunctional alcohol esters such as ethylene glycol diacrylate and polypropylene glycol diacrylate. These may be homopolymers produced by polymerizing a single monomer or copolymers produced by polymerizing two or more types of monomers. The polymer particles may be made of a copolymer such as a random copolymer or a block copolymer. In particular, the polymer particles are preferably made from a hydrophilic monomer and a hydrophobic monomer. Examples of the hydrophilic monomer include α,β-unsaturated carboxylic acids and salts thereof. Examples of the hydrophobic monomer include α,β-unsaturated carboxylic esters and α,β-ethylenically unsaturated compounds containing an aryl group.

The polyurethane particles are those produced by the reaction of a polyisocyanate, which is a compound containing two or more isocyanate groups, with a polyol, which is a compound containing two or more hydroxyl groups. In the present invention, polyurethane particles obtained by the reaction of a known polyisocyanate with a known polyol may be used if the polyurethane particles meet requirements for the polymer particles.

The polymer particles may have a single-layer structure or a multilayer structure such as a core-shell structure. In the present invention, the polymer particles preferably have the multilayer structure. In particular, the polymer particles preferably have the core-shell structure. When the polymer particles have the core-shell structure, a core portion and a shell portion are functionally separated from each other. When the polymer particles have the core-shell structure, the polymer particles are more advantageous than polymer particles having a single-layer structure in that more functions can be applied to the ink.

Compounds Represented by Formulae (1) and (2)

In the present invention, the ink contains at least one the compound represented by Formula (1) below and the compound represented by Formula (2) below.

(1)

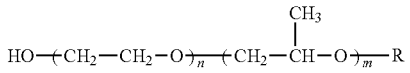

In Formula (1), R is an alkyl group containing one to 22 carbon atoms, n is 3.0 to 27.0, and m is 2.0 to 15.0. The compound represented by Formula (1) is a block copolymer having an ethylene oxide structure and a propylene oxide structure. The alkyl group may be linear or branched and is preferably linear. The alkyl group preferably contains ten to 16 carbon atoms.

(2)

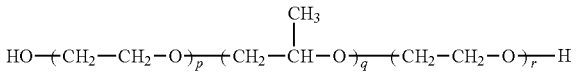

In Formula (2), the sum of p and r is 3.0 to 27.0, q is 16.0 to 31.0, and p and r are preferably 1.0 to 26.0. The compound represented by Formula (2) is an ABA-type block copolymer having an ethylene oxide structure, propylene oxide structure, and ethylene oxide structure arranged in that order.

Examples of the compounds represented by Formulae (1) and (2) include products, such as EMALEX DAPE-0203, EMALEX DAPE-0205, EMALEX DAPE-0207, EMALEX DAPE-0210, EMALEX DAPE-0212, EMALEX DAPE-0215, EMALEX DAPE-0220, and EMALEX 510, available from Nihon-Emulsion Co., Ltd.; FINESURF 560 available from Aoki Oil Industrial Co., Ltd.; and products, such as Adeka Pluronic L31, Adeka Pluronic L34, Adeka Pluronic L61, and Adeka Pluronic L64, available from Adeka Corporation.

In the present invention, the sum of the content of the compound represented by Formula (1) in the ink and the content of the compound represented by Formula (2) in the ink preferably is 1.0% to 15.0% by mass and more preferably 3.0% to 15.0% by mass on the basis of the mass of the ink. The sum of the content of the compound represented by Formula (1) in the ink and the content of the compound represented by Formula (2) in the ink is preferably 0.15 to 10.00 times the content of the polymer particles in the ink on a mass basis.

Colorant

In the present invention, the ink may further contain the colorant. Examples of the colorant include pigments and dyes. Any known pigments and dyes can be used herein. In the present invention, from the viewpoint of the water resistance of images, a pigment is preferably used. The content of the colorant in the ink is preferably 0.1% to 15.0% by mass and more preferably 1.0% to 10.0% by mass on the basis of the mass of the ink.

In the present invention, when the colorant used is a pigment, the pigment is in the form of a dispersion and is a polymer dispersion type of pigment (a polymer dispersion pigment containing a polymer dispersant, a microcapsule pigment containing pigment particles coated with polymer, or a polymer-attached pigment containing pigment particles having polymer-containing organic groups chemically bonded to the surfaces thereof) containing polymer serving as a dispersant or a self-dispersion type of pigment (a self-dispersion pigment) containing pigment particles having hydrophilic groups introduced to the surfaces thereof. Pigments dispersed in different ways may be used in combination. In particular, the pigment used is preferably carbon black or an organic pigment. One or more types of pigments may be used alone or in combination. When the colorant, which is used in the ink, is the polymer dispersion type of pigment, a polymer dispersant is used. The polymer dispersant preferably has a hydrophilic site and a hydrophobic site. Examples of the polymer dispersant include acrylic polymers produced by polymerizing a carboxyl group-containing monomer such as acrylic acid or methacrylic acid and urethane polymers produced by polymerizing an anionic group-containing diol such as dimethylolpropionic acid. The polymer dispersant preferably has an acid value of 50 mg-KOH/g to 300 mg-KOH/g. The polymer dispersant preferably has a weight-average molecular weight (Mw) of 1,000 to 15,000 in terms of polystyrene as determined by GPC. The content of the polymer dispersant in the ink is preferably 0.1% to 10.0% by mass and more preferably 0.2% to 4.0% by mass on the basis of the mass of the ink. The content of the polymer dispersant in the ink is preferably 0.1 to 1.0 times the content of the colorant in the ink on a mass basis.

Aqueous Medium

In the present invention, the ink may further contain an aqueous medium that is water or a solvent mixture of water and a water-soluble organic solvent. The content of the water-soluble organic solvent in the ink is preferably 3.0% to 50.0% by mass on the basis of the mass of the ink. The water-soluble organic solvent may be a common one conventionally used. Examples of the water-soluble organic solvent include alcohols, glycols, alkylene glycols containing an alkylene group containing two to six carbon atoms, polyethylene glycols, nitrogen-containing compounds, and sulfur-containing compounds. These compounds may be used alone or in combination. The water used is preferably deionized water (ion-exchanged water). The content of the water in the ink is preferably 50.0% to 95.0% by mass on the basis of the mass of the ink.

Other Components

In the present invention, the ink may further contain polyfunctional alcohols such as trimethylolpropane and trimethylolethane, urea, urea derivatives such as ethyleneurea, and water-soluble organic compounds which are solid at room temperature as required in addition to the above components. The ink may further contain various additives such as surfactants other than the compounds represented by Formulae (1) and (2), pH adjusters, rust preventives, preservatives, fungicides, antioxidants, reducing inhibitors, evaporation promoters, chelating agents, and polymers other than the polymer particles as required.

Intermediate Transfer Body

In the present invention, the intermediate transfer body serves as a substrate which holds the liquid composition and the ink and on which the intermediate image is recorded. The intermediate transfer body includes, for example, a support member for transmitting necessary power for handling the support member and a surface layer member on which the intermediate image is recorded. The support member may be integrated with the surface layer member.

Examples of the shape of the intermediate transfer body include a sheet shape, a roller shape, a drum shape, a belt shape, and an endless web shape. The size of the intermediate transfer body can be appropriately set depending on the size of a recordable recording medium. The support member, which is included in the intermediate transfer body, needs to have a certain degree of strength from the viewpoint of the conveyance accuracy and durability of the intermediate transfer body. Preferred examples of a material for forming the support member include metals, ceramics, and polymers. In particular, the following materials are preferred: aluminium, iron, stainless steel, an acetal polymer, an epoxy polymer, polyimide, polyethylene, polyethylene terephthalate, nylon, polyurethane, silica ceramic, and alumina ceramic. When the support member is made of at least one of these materials, rigidity sufficient to endure the pressure applied thereto during transfer and dimensional accuracy can be ensured and inertia can be reduced during operation to increase the responsiveness of control. These materials may be used alone or in combination. The surface layer member, which is included in the intermediate transfer body, needs to have a certain degree of elasticity because the intermediate image is transferred to the recording medium, such as paper, by pressure bonding. Supposing that the recording medium is made of, for example, paper, the surface layer member preferably has a durometer-A hardness (durometer type-A hardness) of 10 to 100 and more preferably 20 to 60 as determined in accordance with JIS K 6253.

Liquid Composition

As described above, in the present invention, the image recording method may include the step of applying the liquid composition, which contains the reactant precipitating or aggregating an ink component (a colorant, polymer, or the like) to the intermediate transfer body. The reactant may be a known compound and, in particular, is preferably at least one of a polyvalent metal ion and an organic acid. The liquid composition preferably contains different types of reactants.

Examples of the polyvalent metal ion include divalent metal ions such as $Ca^{2+}$, $Cu^{2+}$, $Ni^{2+}$, $Mg^{2+}$, $Sr^{2+}$, $Ba^{2+}$, and $Zn^{2+}$ and trivalent metal ions such as $Fe^{3+}$, $Cr^{3+}$, $Y^{3+}$, and $Al^{3+}$. In the present invention, the polyvalent metal ion can be added to the liquid composition in the form of a salt such as a hydroxide or a chloride and may be used as an ion produced by dissociation. In the present invention, the content of the polyvalent metal ion in the liquid composition is preferably 3% to 90% by mass on the basis of the mass of the liquid composition.

Examples of the organic acid include oxalic acid, polyacrylic acid, formic acid, acetic acid, propionic acid, glycolic acid, malonic acid, malic acid, maleic acid, ascorbic acid, levulinic acid, succinic acid, glutaric acid, glutamic acid, fumaric acid, citric acid, tartaric acid, lactic acid, pyrrolidone carboxylic acid, pyrone carboxylic acid, pyrrole carboxylic acid, furan carboxylic acid, pyridine carboxylic acid, coumalic acid, thiophene carboxylic acid, nicotinic acid, oxysuccinic acid, oxysuccinic acid, and dioxysuccinic acid. In the present invention, the content of the organic acid in the liquid composition is preferably 3% to 99% by mass on the basis of the mass of the liquid composition.

The liquid composition may further contain an aqueous medium and another compound. The aqueous medium and the compound may be the same as those usable in the ink.

In the present invention, the liquid composition is preferably colorless, translucent, or white in order not to affect an image recorded with the ink. Therefore, the ratio (maximum absorbance/minimum absorbance) of the maximum to minimum absorbance of the liquid composition is preferably 1.0 to 2.0 at a wavelength of 400 nm to 800 nm, that is, in the visible wavelength range. This means that the liquid composition has substantially no absorption peak or an absorption peak with extremely low intensity. In the present invention, the liquid composition preferably contains no colorant. The undiluted liquid composition may be measured for absorbance using a Hitachi double beam spectrophotometer, U-2900, available from Hitachi High-Technologies Corporation. The diluted liquid composition may be measured for absorbance. This is because the maximum absorbance and minimum absorbance of the liquid composition are both proportional to the dilution ratio thereof and therefore the ratio (maximum absorbance/minimum absorbance) of the maximum to minimum absorbance of the liquid composition does not depend on the dilution ratio thereof.

Examples

The present invention is further described below in detail with reference to examples and comparative examples. The present invention is not limited to the examples without departing from the scope of the present invention. In the description of the examples, "parts" are on a weight basis unless otherwise specified.

Preparation of Inks

Preparation of Pigment Dispersion

The following materials were mixed: ten parts of carbon black, Monarch® 1100, available from Cabot Corporation; 15 parts of an aqueous polymer solution containing a styrene-ethyl acrylate-acrylic acid copolymer having an acid value of 150 and a weight-average molecular weight of 8,000, the aqueous polymer solution being prepared by neutralizing an aqueous solution having a polymer content of 20.0% by mass with an aqueous solution of potassium hydroxide; and 75 parts of pure water. The mixture and 200 parts of zirconia beads with a size of 0.3 mm were charged into a batch-type vertical sand mill available from AIMEX Co., Ltd., and were then dispersed for five hours in such a manner that the sand mill was water-cooled. The dispersion was centrifuged such that coarse particles were removed therefrom, whereby a pigment dispersion having a pigment content of 10.0% by mass was obtained.

Preparation of Aqueous Dye Solution

An aqueous dye solution having a dye content of 10.0% by mass was prepared using C.I. Direct Black 195.

Preparation of Polymer Particle Dispersions

Preparation of Polymer Particle Dispersion 1

Polymer Particle Dispersion 1 having a polymer content of 20.0% by mass was prepared using Joncryl 7001 (a softening point of 12° C.) available from BASF.

Preparation of Polymer Particle Dispersion 2

Polymer Particle Dispersion 2 having a polymer content of 20.0% by mass was prepared using ST-200 (a softening point of 55° C.) available from Nippon Shokubai Co., Ltd.

Preparation of Polymer Particle Dispersion 3

Polymer Particle Dispersion 3 having a polymer content of 20.0% by mass was prepared using HYTEC S-3121 (a softening point of 77° C.) available from Toho chemical Industry Co., Ltd.

Preparation of Surfactants

Surfactants shown in Tables 1 and 2 were prepared.

TABLE 1

(1)

$$HO-(CH_2-CH_2-O)_n-(CH_2-\underset{\displaystyle CH_3}{\underset{|}{CH}}-O)_m-R$$

| Surfactants | n | m | Number of carbon atoms in R | Product name |
|---|---|---|---|---|
| Surfactants 1-1 | 3.0 | 2.0 | 10 | EMALEX DAPE-0203*1 |
| Surfactants 1-2 | 5.0 | 2.0 | 10 | EMALEX DAPE-0205*1 |
| Surfactants 1-3 | 7.0 | 2.0 | 10 | EMALEX DAPE-0207*1 |
| Surfactants 1-4 | 10.0 | 2.0 | 10 | EMALEX DAPE-0210*1 |
| Surfactants 1-5 | 12.0 | 2.0 | 10 | EMALEX DAPE-0212*1 |
| Surfactants 1-6 | 15.0 | 2.0 | 10 | EMALEX DAPE-0215*1 |
| Surfactants 1-7 | 20.0 | 2.0 | 10 | EMALEX DAPE-0220*1 |
| Surfactants 1-8 | 3.0 | 2.0 | 10 | EMALEX DAPE-0203*1 |
| Surfactants 1-9 | 30.0 | 2.0 | 10 | EMALEX DAPE-0230*1 |
| Surfactants 1-10 | 1.0 | 4.0 | 16 | NIKKOL PBC-31*2 |

*1 Available from Nihon-Emulsion Co., Ltd.
*2 Available from Nikko Chemicals Co., Ltd.

TABLE 2

(2)

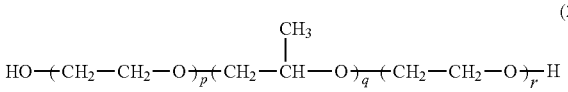

| Surfactants | p + r | q | Product name |
|---|---|---|---|
| Surfactant 2-1 | 3.4 | 16.4 | Pluronic L31*1 |
| Surfactant 2-2 | 14.4 | 16.4 | Pluronic L34*1 |
| Surfactant 2-3 | 21.6 | 15.4 | Pluronic L35*1 |
| Surfactant 2-4 | 5.7 | 30.2 | Pluronic L61*1 |
| Surfactant 2-5 | 5.2 | 35.3 | Pluronic L71*1 |
| Surfactant 2-6*2 | 2.7 | 16.2 | |
| Surfactant 2-7*2 | 26.5 | 31.7 | |
| Surfactant 2-8*2 | 3.8 | 31.6 | |

*1Available from Adeka Corporation.
*2Synthesized by the inventors.

Preparation of Inks

Each of the polymer particle dispersions obtained as described above and the pigment dispersion or the aqueous dye solution were mixed with components as described below. The balance for ion-exchanged water corresponds to such an amount that all components forming ink total 100.00% by mass.

Pigment dispersion or aqueous dye solution (a colorant content of 10.0% by mass): 20.0% by mass Polymer particle dispersion (a polymer content of 20.0% by mass): X mass percent shown in Table 3

Glycerin: 10.0% by mass

Surfactant: Y mass percent shown in Table 3

Ion-exchanged water: balance

These components were sufficiently dispersed by agitation, followed by pressure filtration using a micro-filter, having a pore size of 3.0 μm, available from Fuji Photo Film Co., Ltd., whereby each ink was prepared.

TABLE 3

| Inks | Pigment dispersion or aqueous dye solution (a colorant content of 10.0% by mass) | Fine polymer particle dispersions (a polymer content of 20.0% by mass) No. | Softening point (° C.) | Content X (mass percent) | Surfactants: Surfactants | Surfactants: Content Y (mass percent) | Surfactant/fine polymer particles (times) |
|---|---|---|---|---|---|---|---|
| Ink 1 | Pigment dispersion | 2 | 55 | 30.0 | Surfactant 2-1 | 5.0 | 0.83 |
| Ink 2 | Aqueous dye solution | 2 | 55 | 30.0 | Surfactant 2-1 | 5.0 | 0.83 |
| Ink 3 | Pigment dispersion | 1 | 12 | 30.0 | Surfactant 2-1 | 5.0 | 0.83 |
| Ink 4 | Pigment dispersion | 3 | 77 | 30.0 | Surfactant 2-1 | 5.0 | 0.83 |
| Ink 5 | Pigment dispersion | 2 | 55 | 30.0 | Surfactant 1-2 | 5.0 | 0.83 |
| Ink 6 | Pigment dispersion | 2 | 55 | 30.0 | Surfactant 1-3 | 5.0 | 0.83 |
| Ink 7 | Pigment dispersion | 2 | 55 | 30.0 | Surfactant 1-4 | 5.0 | 0.83 |
| Ink 8 | Pigment dispersion | 2 | 55 | 30.0 | Surfactant 1-5 | 5.0 | 0.83 |
| Ink 9 | Pigment dispersion | 2 | 55 | 30.0 | Surfactant 1-6 | 5.0 | 0.83 |
| Ink 10 | Pigment dispersion | 2 | 55 | 30.0 | Surfactant 1-7 | 5.0 | 0.83 |
| Ink 11 | Pigment dispersion | 2 | 55 | 30.0 | Surfactant 2-2 | 5.0 | 0.83 |
| Ink 12 | Pigment dispersion | 2 | 55 | 30.0 | Surfactant 1-1 | 5.0 | 0.83 |
| Ink 13 | Pigment dispersion | 2 | 55 | 30.0 | — | 0 | 0 |
| Ink 14 | Pigment dispersion | 2 | 55 | 30.0 | SILWET L7604* | 5.0 | — |
| Ink 15 | Pigment dispersion | 2 | 55 | 30.0 | SILWET L7001* | 5.0 | — |
| Ink 16 | Pigment dispersion | 2 | 55 | 30.0 | Surfactant 1-10 | 5.0 | 0.83 |
| Ink 17 | Pigment dispersion | 2 | 55 | 30.0 | Surfactant 1-8 | 5.0 | 0.83 |
| Ink 18 | Pigment dispersion | 2 | 55 | 30.0 | Surfactant 2-3 | 5.0 | 0.83 |
| Ink 19 | Pigment dispersion | 2 | 55 | 30.0 | Surfactant 1-9 | 5.0 | 0.83 |
| Ink 10 | Pigment dispersion | 2 | 55 | 30.0 | Surfactant 2-6 | 5.0 | 0.83 |
| Ink 21 | Pigment dispersion | 2 | 55 | 30.0 | Surfactant 2-4 | 5.0 | 0.83 |
| Ink 22 | Pigment dispersion | 2 | 55 | 30.0 | Surfactant 2-5 | 5.0 | 0.83 |
| Ink 23 | Pigment dispersion | 2 | 55 | 30.0 | Surfactant 2-7 | 5.0 | 0.83 |
| Ink 24 | Pigment dispersion | 2 | 55 | 30.0 | Surfactant 2-8 | 5.0 | 0.83 |
| Ink 25 | Pigment dispersion | 2 | 55 | 5.0 | Surfactant 2-1 | 1.0 | 1.00 |
| Ink 26 | Pigment dispersion | 2 | 55 | 15.0 | Surfactant 2-1 | 3.0 | 1.00 |
| Ink 27 | Pigment dispersion | 2 | 55 | 15.0 | Surfactant 2-1 | 15.0 | 5.00 |
| Ink 28 | Pigment dispersion | 2 | 55 | 20.0 | Surfactant 2-1 | 20.0 | 5.00 |
| Ink 29 | Pigment dispersion | 2 | 55 | 35.7 | Surfactant 2-1 | 1.0 | 0.14 |
| Ink 30 | Pigment dispersion | 2 | 55 | 33.3 | Surfactant 2-1 | 1.0 | 0.15 |

TABLE 3-continued

| Inks | Pigment dispersion or aqueous dye solution (a colorant content of 10.0% by mass) | Fine polymer particle dispersions (a polymer content of 20.0% by mass) No. | Softening point (° C.) | Content X (mass percent) | Surfactants | Content Y (mass percent) | Surfactant/ fine polymer particles (times) |
|---|---|---|---|---|---|---|---|
| Ink 31 | Pigment dispersion | 2 | 55 | 7.5 | Surfactant 2-1 | 15.0 | 10.00 |
| Ink 32 | Pigment dispersion | 2 | 55 | 7.4 | Surfactant 2-1 | 15.0 | 10.10 |

*Silicone surfactants which are available from Nippon Unicar Co., Ltd. and which do not correspond to a compound represented by Formula (1) or (2).

Preparation of Liquid Compositions

Preparation of Liquid Composition 1

The following materials were mixed and were agitated: 30 parts of glutaric acid; five parts of glycerin; five parts of potassium hydroxide; one part of a surfactant, Acetylenol E100, available from Kawaken Fine Chemicals Co., Ltd.; and 59 parts of ion-exchanged water. The mixture was pressure-filtered through a micro-filter, having a pore size of 3.0 μm, available from Fuji Photo Film Co., Ltd., whereby Liquid Composition 1 was prepared.

Preparation of Liquid Composition 2

The following materials were mixed and were agitated: 30 parts of potassium nitrate tetrahydrate; five parts of glycerin; one part of a surfactant, Acetylenol E100, available from Kawaken Fine Chemicals Co., Ltd.; and 64 parts of ion-exchanged water. The mixture was pressure-filtered through a micro-filter, having a pore size of 3.0 μm, available from Fuji Photo Film Co., Ltd., whereby Liquid Composition 2 was prepared.

Evaluation of Transfer Efficiency

The inks and liquid compositions obtained as described above were filled in ink cartridges and the ink cartridges were mounted on an image recording apparatus shown in the FIGURE in combinations shown in Table 4. Each of the liquid compositions obtained as described above was applied to an intermediate transfer body using an application roller. Each ink was ejected from an ink jet type of recording head, whereby an intermediate image with a recording duty of 100%, that is, a solid image with a size of 2 cm×2 cm was recorded on the intermediate transfer body coated with the liquid composition. In the image recording apparatus, conditions for applying eight ink droplets with a weight of 3.5 ng to a unit region with a size of 1/600 inch×1/600 inch at a resolution of 600 dpi×600 dpi are defined to be a recording duty of 100%. The intermediate image was transferred to a recording medium, Auroracoat, available from Nippon Paper Industries Co., Ltd. at a transfer rate of 2.0 m/s using a pressure roller heated to a predetermined transfer temperature (80° C. or 60° C.) shown in Table 4. After a series of these steps were repeated 25 times, the proportion of the intermediate image remaining on a surface of the intermediate transfer body, that is, the transfer residual ratio (%) was calculated. In particular, the transfer residual ratio was determined in such a manner that the intermediate transfer body was disengaged from a support member, a surface thereof was taken into an image, and the percentage of the area of the intermediate image remaining on the intermediate transfer body without being transferred in the area where the intermediate image was recorded was calculated. The transfer efficiency was evaluated from the transfer residual ratio. Evaluation standards are as described below. In the present invention, in the evaluation standards, A and B were allowable levels and C was an unallowable level. Evaluation results are shown in Table 4.

A: a transfer residual ratio of 10% or less and high transfer efficiency.

B: a transfer residual ratio of more than 10% to 15% or less and somewhat high transfer efficiency.

C: a transfer residual ratio of more than 15% and low transfer efficiency.

TABLE 4

| Examples | Inks | Liquid compositions | Transfer temperature (° C.) | Evaluation results Transfer efficiency |
|---|---|---|---|---|
| Example 1 | Ink 1 | Liquid Composition 1 | 80 | A |
| Example 2 | Ink 2 | Liquid Composition 1 | 80 | A |
| Example 3 | Ink 3 | Liquid Composition 1 | 80 | A |
| Example 4 | Ink 4 | Liquid Composition 1 | 80 | A |
| Example 5 | Ink 1 | Liquid Composition 2 | 80 | A |
| Example 6 | Ink 5 | Liquid Composition 1 | 80 | A |
| Example 7 | Ink 6 | Liquid Composition 1 | 80 | A |
| Example 8 | Ink 7 | Liquid Composition 1 | 80 | A |
| Example 9 | Ink 8 | Liquid Composition 1 | 80 | A |
| Example 10 | Ink 9 | Liquid Composition 1 | 80 | A |
| Example 11 | Ink 10 | Liquid Composition 1 | 80 | A |
| Example 12 | Ink 11 | Liquid Composition 1 | 80 | A |
| Example 13 | Ink 12 | Liquid Composition 1 | 80 | A |
| Example 14 | Ink 17 | Liquid Composition 1 | 80 | A |
| Example 15 | Ink 21 | Liquid Composition 1 | 80 | A |
| Example 16 | Ink 25 | Liquid Composition 1 | 80 | B |
| Example 17 | Ink 26 | Liquid Composition 1 | 80 | A |
| Example 18 | Ink 27 | Liquid Composition 1 | 80 | A |
| Example 19 | Ink 28 | Liquid Composition 1 | 80 | B |
| Example 20 | Ink 29 | Liquid Composition 1 | 80 | B |

TABLE 4-continued

| Examples | Inks | Liquid compositions | Transfer temperature (° C.) | Evaluation results Transfer efficiency |
|---|---|---|---|---|
| Example 21 | Ink 30 | Liquid Composition 1 | 80 | A |
| Example 22 | Ink 31 | Liquid Composition 1 | 80 | A |
| Example 23 | Ink 32 | Liquid Composition 1 | 80 | B |
| Comparative Example 1 | Ink 13 | Liquid Composition 1 | 80 | C |
| Comparative Example 2 | Ink 4 | Liquid Composition 1 | 60 | C |
| Comparative Example 3 | Ink 14 | Liquid Composition 1 | 80 | C |
| Comparative Example 4 | Ink 15 | Liquid Composition 1 | 80 | C |
| Comparative Example 5 | Ink 16 | Liquid Composition 1 | 80 | C |
| Comparative Example 6 | Ink 18 | Liquid Composition 1 | 80 | C |
| Comparative Example 7 | Ink 19 | Liquid Composition 1 | 80 | C |
| Comparative Example 8 | Ink 20 | Liquid Composition 1 | 80 | C |
| Comparative Example 9 | Ink 22 | Liquid Composition 1 | 80 | C |
| Comparative Example 10 | Ink 23 | Liquid Composition 1 | 80 | C |
| Comparative Example 11 | Ink 24 | Liquid Composition 1 | 80 | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-138390 filed Jun. 20, 2012, which is hereby incorporated by reference herein in its entirety.

What is claimed is:

1. An image recording method comprising:

an intermediate image-recording step of recording an intermediate image by applying ink to an intermediate transfer body; and a transfer step of transferring the intermediate image to a recording medium by heating the intermediate image to a transfer temperature, wherein the ink contains polymer particles having a softening point not higher than the transfer temperature and at least one of a compound represented by the following formula (1) and a compound represented by the following formula (2):

(1)

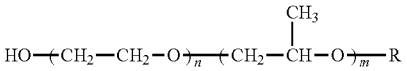

(2)

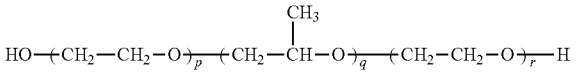

where R is an alkyl group containing one to 22 carbon atoms, n is 3.0 to 27.0, m is 2.0 to 15.0, the sum of p and r is 3.0 to 27.0, and q is 16.0 to 31.0, wherein the sum of the content of the compound represented by Formula (1) in the ink and the content of the compound represented by Formula (2) in the ink is preferably 0.15 to 10.00 times the content of the polymer particles in the ink on a mass basis.

2. The image recording method according to claim 1, wherein the sum of the content of the compound represented by Formula (1) in the ink and the content of the compound represented by Formula (2) in the ink is 3.0% to 15.0% by mass on the basis of the mass of the ink.

3. The image recording method according to claim 1, wherein the polymer particles have a 50% accumulated volume-average particle diameter of 10 nm to 1,000 nm.

4. The image recording method according to claim 1, wherein the content of the polymer particles in the ink is 1.0% to 50.0% by mass on the basis of the mass of the ink.

5. The image recording method according to claim 1, wherein the ink contains a colorant and the content of the polymer particles in the ink is 0.2 to 20 times the content of the colorant in the ink on a mass basis.

6. The image recording method according to claim 1, further comprising a liquid composition-applying step of applying a liquid composition containing at least one of a polyvalent metal ion and an organic acid to the intermediate transfer body.

7. The image recording method according to claim 6, wherein the liquid composition-applying step is performed prior to the intermediate image-recording step.

* * * * *